United States Patent [19]

McClintock

[11] 3,983,690

[45] Oct. 5, 1976

[54] DIGITAL TIMEPIECE HAVING CHRONOMETRIC DISPLAY

[75] Inventor: Richard D. McClintock, Woodbury, Conn.

[73] Assignee: McSohmer Corporation, Hauppague, N.Y.

[22] Filed: May 19, 1975

[21] Appl. No.: 578,510

[52] U.S. Cl. ..... 58/50 R; 58/23 R

[51] Int. Cl.[2] ..... G04B 19/30

[58] Field of Search..... 58/23 R, 50, 58, 85.5, 58/152 H

[56] References Cited

UNITED STATES PATENTS

| | | | |
|---|---|---|---|
| 3,742,699 | 7/1973 | Bergey | 58/23 R |
| 3,817,023 | 6/1974 | Kashio | 58/85.5 |
| 3,828,547 | 8/1974 | Fujita | 58/50 R |
| 3,841,087 | 10/1974 | Kikuchi | 58/152 H |
| 3,911,664 | 10/1975 | Haber | 58/23 R |

*Primary Examiner*—Joseph F. Peters, Jr.
*Assistant Examiner*—Vit W. Miska
*Attorney, Agent, or Firm*—Hubbell, Cohen, Stiefel & Gross

[57] ABSTRACT

In an improved digital timepiece having a chronometric display in which a digital timing means provides chronometric timing signals thereto, includes first condition responsive means responsive to an enabling signal for activating the chronometric display to provide a chronometric display from the timing signal, the improvement comprises electronic means responsive to human touch for providing the enabling signal.

The electronic means comprises a resistive sensitive voltage divider switch means which provides a resistive impedance path to ground in response to human touch thereof, and second condition responsive means which provides the enabling signal to the first condition responsive means initially in response to the resistive impedance path to ground being provided. Delay means are operatively connected between the second condition responsive means output and the first condition responsive means input which is responsive to the provision of the resistive impedance path for maintaining the first condition responsive means input signal as the enabling signal for a predetermined delay interval while the human touch responsive means is still providing a resistive impedance path to ground, the delay means thereafter changing the first condition responsive means input signal from the enabling signal to a different input signal while the enabling signal is still being provided from the second condition responsive means output to revert the first condition responsive means to its initial condition which deactivates the chronometric display. Instead of being responsive to human touch, he electronic means can have a controlled sensitivity so as to be solely responsive to conductive touch which provides a conductive voltage of less than the voltage at which water is substantially conductive with the electronic means in such instance comprising at least a pair of spaced apart conductive touchable means connected between the power source and the second condition responsive means whereby the provision of the chronometric display is insensitive to the conductively bridgeable touch of conductive contaminants between the spaced apart conductive touchable means pair which provides a conductive voltage equal to or greater than the voltage at which water is substantially conductive.

17 Claims, 7 Drawing Figures

DIGITAL TIMEPIECE HAVING CHRONOMETRIC DISPLAY

BACKGROUND OF THE INVENTION

1. Field of the Invention

The present invention relates to digital timepieces having chronometric displays which may be activated at will.

2. Description of the Prior Art

Digital timepieces, such as digital wrist watches, are well known, such as those that are commercially available under the name PULSAR. These prior art digital watches have chronometric light emitting diode displays of the time and/or date, etc. These displays are normally provided in response to the depression of a button located on the outside of the case. Thus, a hole must normally be provided through the case to allow for movement of the button into and out of the case to switch the display on and off. The depression of the button activates or turns on the display, acting as a switch, to complete the circuit to the conventional digital watch module which contains additional timing circuitry, such as commercially available from National Semiconductor of the type available in their watch distributed under the name NOVUS, or the type commercially available from HMW Industries, Inc., employed in their digital watch distributed under the name PULSAR. These digital watch modules provide digital timing which is displayed in conventional analog fashion in the chronometric display such as of time in hours and minutes, as well as in seconds (after a predetermined interval) and/or subsequent display of the date. Such digital prior art watches, however, are subject to accidental activation of the display, such as due to banging of the activation button, which causes current drain on the limited power source. In addition, the resetting of these watches is also accomplished by a mechanical button which when accidentally activated can significantly alter the synchronization of the timing so that an improper chronometric display will be provided. In an attempt to overcome this problem, prior art watches, such as the PULSAR, have sought to use a magneitc switch rather than a mechanical switch to activate the chronometric display or to enable reset of the watch. However, such a prior art arrangement can develop problems if dust gathers behind the magnetically actuated button as well as preventing such operation if the magnet is accidentally lost. Another prior art attempt to overcome this problem has involved the use of recessed buttons in the case which are actuated by insertion of a pointed instrument into the case. However, this can result in damage to the delicate mechanism contained within the case if not done properly. These disadvantages of the prior art are overcome by the present invention.

SUMMARY OF THE INVENTION

An improved digital timepiece having a chronometric display means which includes electronic means including conductive touchable means capable of being rendered conductive to ground by human touch thereof to activate the chronometric display is provided. The timepiece includes a digital timiing means operatively connected to the display means for providing chronometric timing signals thereto, such as the conventional type utilized by National Semiconductor in it NOVUS watch of HMW Industries, Inc. in its PULSAR digital watch, and a power source means operatively connected to the timing means and display means for enabling the operation thereof. The digital timing means includes first condition responsive means responsive to an enabling signal for activating the chronometric display, such as a light emitting diode display, to provide a chronometric display from the timing signal, such as an alphanumeric display, such as date and month, or a numeric display, such as hours, minutes or seconds. The improved digital timepiece includes second condition responsive means, such as a gating network, having an initial condition and an enable condition with the touchable means being connectable between the power source and ground. Human touch of the touchable means renders the touchable means conductive to ground and the second condition responsive means is initially responsive to this touchable means being rendered conductive to ground for changing the second condition responsive means from its initial condition to its enable conditiion. The enabling signal which activates the chronometric display is only provided in this enable condition. Delay means such as a resistive-capacitive network, is operatively connected to the second condition responsive means for changing the second condition responsive means from its enable condition back to its initial condition after a predetermined delay interval while the touchable means is still conductive to ground to thereby insure termination of the chronometric display within this interval. In addition, the delay means may include means for substantially instantaneously changing the second condition responsive means from its enable condition back to its initial condition after the human touch is removed from the touchable means which touch removal renders the touchable means non-conductive to ground, thereby substantially instantaneously terminating the chronometric display. The predetermined delay interval referred to above is preferably provided by an RC time constant for the resistive-capacitive network.

In one embodiment, the digital timepiece electronic means comprises a voltage divider between the power source and the second condition responsive means, with the voltage divider comprising the conductive touchable means and a separate imepdance connected in series therewith across the power source. The conductive touchable means has one associated impedance (such as effectively an open circuit impedance) when non-conductive to ground and a different associated impedance when rendered conductive to ground with the non-conductive-to-ground associated impedance being greater than the impedance of the other portion of the voltage divider and with the conductive-to-ground impedance being less than that impedance. Thus, the second condition responsive means is changed from its initial condition to its enable condition whenever the conductive touchable means associated impedance is lower than the impedance of the other portion of the voltage divider. This conductive touchable means may comprise a contact plate such as an inlay or some other conductive material such as a metal film or bar.

In another embodiment, rather than being responsive to human touch, the electronic means comprises means responsive to a low ohmic metallic connection which connection when present, results in a conductive voltage to the sensor of less than the voltage at which water is conductive. When such a low level conductive voltage is sensed, the second condition responsive means is changed from its initial condition to its enable condition. Thus, the electronic means is thereby rendered insensitive to accidental activation by the presence of moisture on the touchable means.

DETAILED DESCRIPTION OF THE PREFERRED EMBODIMENTS

Figure 1:
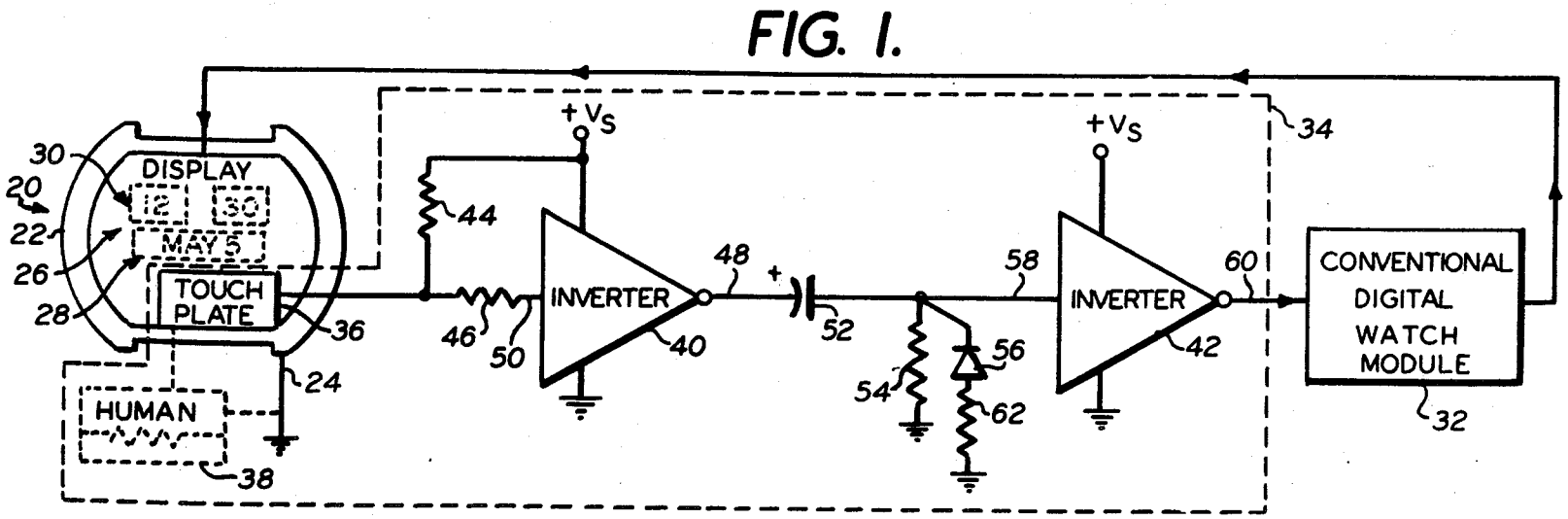
FIG. 1 is a diagramatic illustration, partially in schematic, of the preferred embodiment of the improved digital timepiece of the present invention.

Referring now to the drawings in detail, and initially to FIG. 1 thereof, the presently preferred embodiment for an improved digital timepiece, illustratively shown as a digital wrist watch, generally referred to by the reference numeral 20, is shown. The digital wrist watch 20 preferably has a conventional metal watch case 22 which preferably functions in the present invention as ground potential, generally represented by reference numeral 24 in FIG. 1, and a conventional chronometric display 25, such one capable of providing an alphanumeric display of the date, represented by reference numeral 28 and the expression "MAY 5" and/or a purely numeric display, represented by reference numeral 30 by the expression "12 30" which represents the time 12:30. The digital watch 20, except for the electronics 34 for activating the chronometric display which will be described in greater detail hereinafter, is preferably conventional and includes a conventional digital watch module 32, such as the conventional type of digital watch module utilized by HMW Industries, Inc. in the PULSAR digital watch or by National Semiconductors in the NOVUS digital watch. The conventional digital watch module 32, which will not be described in greater detail hereinafter, operates conventionally to provide digital timing signals which when associated with a conventional chronometric display, such as one comprising light emitting diodes, will provide an analog display of chronometric information such as the instantaneous time in hours and minutes and, if desired, in certain models, will also display the time in seconds after a preset interval. In addition, conventional digital watch modules such as module 32 may conventionally be arranged so as to cause the display of the date, such as by month and numeric date, or by numeric date alone, if the control button which activates the time display is reactuated within a preset period after initial actuation of the display, such as conventionally within a two-second period from inital actuation of the numeric display 30 of the time. Furthermore, with respect to the display of the date, if desired, there can be provided a second control or button solely actuating this display.

As will be described in greater detail hereinafter, the improved digital watch illustrated in FIG. 1 preferably utilizes an electronic activation circuit 34 in place of the conventional mechanical control button for activating the chronometric display 26, such as display 30, or display 28, for the digital watch 20. As shown and preferred in FIG. 1, and as will be described in greater detail hereinafter, the electronic activation network 34 is preferably responsive to human touch of a conductive touch plate 36. This conductive touch plate 36 may preferably be any conductive material such as a metal film, a metal bar, or an inlay that may be arranged in any design so as to be ornamental as well as utilitarian for the digital watch 20. As diagramatically illustrated in FIG. 1, when the touch plate 36 is touched by a human, represented schematically by block 38, this provides a conductive path to ground 24, which is preferably the watch case 22, through the body of the human 38, assuming the watch is worn on the wrist or held in the hand at the time of touching of touch plate 36. If the watch is not being worn at the the time, such as being on the table, and activation of the display is desired, then all that is required to complete the circuit to ground is to insure that the human 38 touches both the plate 36 and the watch case 22. This may readily be facilitated by locating the touch plate 36 closely spaced from the edge of the watch case 22 so that during normal intentional touching of touch plate 36, the watch case 22 will assuredly also be contacted or touched. As further shown and preferred, and as will be described in greater detail hereinafter, the electronic activation circuit 34 preferably contains two conventional logic gates, which are preferably inverters 40 and 42, with the enabling signal for ultimately causing the provision of a chronometric display 26 being provided from the output of inverter 42 to the digital watch module 32 which then, after being conventionally activated by receipt of this signal, conventionally causes the turn on of the appropriate display 26.

As also shown and preferred in FIG. 1, the electronic activation circuit 34 comprises a voltage divider input for inverter or logic gate 40 which consists of a predetermined resistive impedance 44, connected to the voltage source, represented by $V_s$, which impedance 44 is in turn connected in series with the conductive touch plate 36. As previously mentioned, touch plate 36, which in the absence of being touched by a human essentially provides an open circuit, is directly connected to ground 24 through the human 38 when the touch plate is touched by the human 38. Thus, the voltage divider comprises resistive impedance 44 and the resistive impedance to ground provided by the touch of human 38, representing the resistive impedance to ground 24. The value of resistive impedance 44 is chosen so as to exceed the resistive impedance to ground provided by the human 38 touching touch plate 36 to render it conductive to ground. Preferably, by way of example, resistive impedance 44 may be on the order of magnitude of 22 megohms. As further shown and preferred, an input portection resistance 46 is preferably connected to the input of inverter 40 which inverter 40 is preferably biased so that the output thereof provided via path 48 is normally low with the input provided at 50 preferably normally being high, this being the normal defined condition of inverter 40 when plate 36 is not being touched by a human and therefore is non-conductive to ground. The output of inverter 40 provided via path 48 is provided to an RC delay network comprising a capacitor 52 and a resistive impedance 54, with RC network 52-54 having a charge RC time constant determined by the values of capacitor 52 and resistive impedance 54. Preferably, by way of example, this charge time constant may be on the order of magnitude of 10 seconds. As further shown and preferred, a diode 56 is preferably connected in parallel with resistive impedance 54 to enable rapid discharge of capacitor 52, as will be described in greater detail hereinafter, immediately after removal of human touch from touch plate 36 without having to wait for the time normally provided by the RC discharge time constant 52-54. This delay network comprising capacitor 52, resistive impedance 54, and diode 56, is, as shown and preferred, connected between the output 48 of inverter 40 and the input 58 of inverter or logic gate 42. As previously mentioned, the output of inverter 42, which is provided via path 60, is the enabling signal which, when received by the conventional digital watch module 32, causes module 32 to operate in conventional fashion to activate the chronometric display 26, such as display 30, by way of example.

Now describing the operation of the embodiment shown in FIG. 1 for activating the chronometric display 26 to provide the time display 30, by way of example. When the touch plate 36 is touched by the human 38, this provides a resistive impedance path to ground 24 which impedance path is lower than the value of resistive impedance 44. Thus, because of this voltage divider, the input to inverter 40 at point 50 goes low, in the example given, thus causing the output of inverter 40, provided at path 48, to go high. When the voltage present on path 48 goes high, this causes capacitor 52 to charge to the value of the source of voltage $V_s$ at the RC time constant provided by 52-54. This then causes the input to inverter 42 provided at point 58, which is normally low, to go high and remain high as long as capacitor 52 is less than half charged. The output of inverter 42, therefore, goes low, with this low output of inverter 42 preferably being the enabling signal provided via path 60 to watch module 32 to activate the watch function which, in the example given, turns on the light emitting diode time display 30 to display the instantaneous time. Assuming the touch plate 36 is still being touched while the display is being provided, capacitor 52 continues to charge through resistive impedance 54 until it reaches $V_s$. However, when capacitor 52 is more than half charged, and touch plate 36 is still being touched, the input to inverter 42 provided at point 58 now goes low which, in turn, causes a high output at path 60 of inverter 42 to thus deactivate the watch function, that is, turn off the display 30 in the example given, as the enable signal will no longer be provided to watch module 32. Thus, the chronometric display is automatically terminated after a present time interval, determined by RC time constant, even though the touch plate is still being touched. This eliminates drain on the battery, such as when in salt water, etc. Whenever human touch is removed from the touch plate 36, capacitor 52 will immediately discharge through diode 56 so that immediately after removal of human touch of touch plate 36, the system can be reactivated. Thus, diode 56 enables a quick reset capability for the system and, as will be described hereinafter, allows for a multiple usage of the same input. As shown and preferred in FIG. 1, a resistive impedance 62 is connected in series with the diode 56 to protect diode 56 from current surges. Thus, when the touch is removed from touch plate 36, this causes the input to inverter 40 to again go high, causing the output of inverter 40 via path 48 to go low, thereby providing the quick discharge path of capacitor 52 through diode 56.

As previously mentioned, the conventional digital watch module, such as represented by module 32, has several modes with the first mode normally turning on the display of hours and minutes, then, after a preset interval, such as two seconds, the time display then displays seconds. However, conventionally if prior to the end of this preset interval, such as the aforementioned two seconds, the touch is removed and the touch switch again were to be touched, the date would then be displayed. Thus, when such a conventional watch module 32 is utilized in the system of FIG. 1, if the touch is removed from touch plate 36 prior to the end of this preset interval, capacitor 52 will immediately discharge through diode 56 and the subsequent retouch of touch plate 36 before the end of this preset interval will cause the date display 28 to be activated by watch module 32. Thus, the make or touch, break or touch removal, and remake or retouch of touch plate 36 must all occur within the preset interval of the watch module 32, such as conventionally two seconds.

Figure 2:
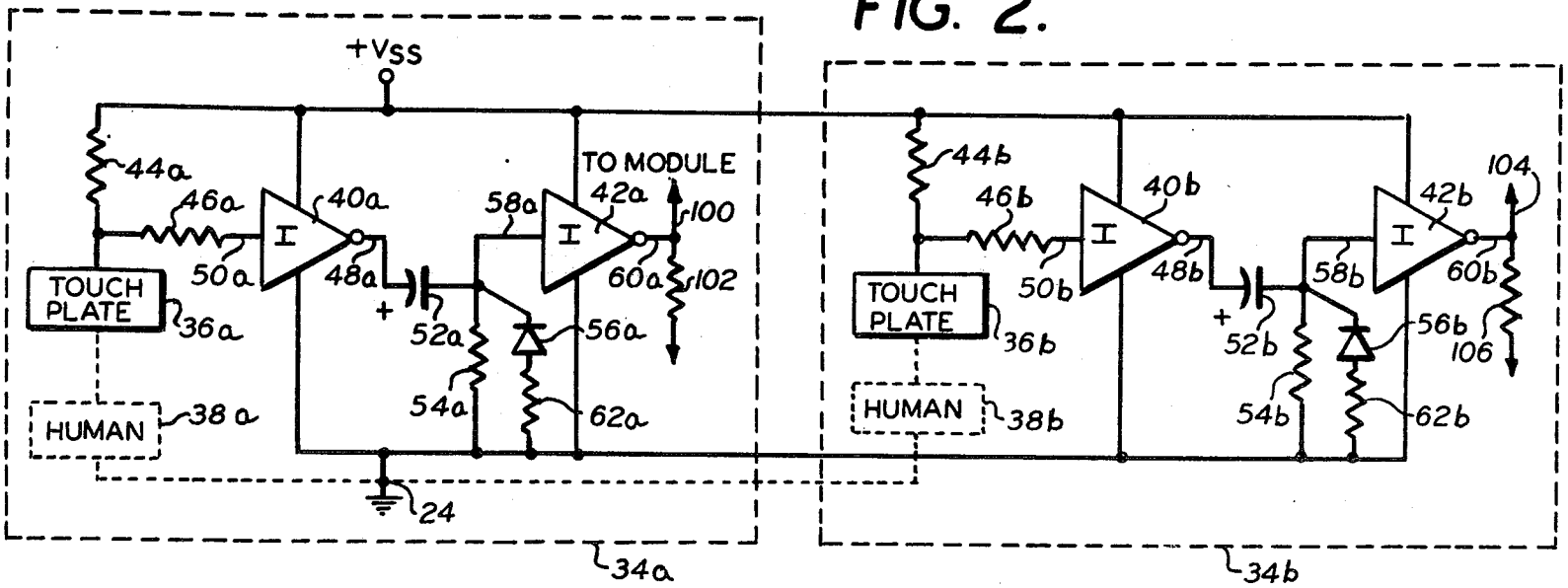
FIG. 2 is a schematic diagram, partially in block, similar to the embodiment of FIG. 1, of a sensor module in accordance with the embodiment of FIG. 1.

FIG. 2 illustrates a multiple level shifter or sensor module circuit illustratively employing two circuits equivalent to the basic electronic activation circuit 34 previously described with reference to FIG. 1. The components of these dual circuits, referred to as **34*a* and 34*b*, are each preferably identical with that previously described with reference to FIG. 1 with respect to the electronic activation circuit 34** and have the same corresponding reference numbers utilized therein followed by the letter *a* for activation circuit **34*a*** and by *b* for activation circuit **34*b*. The operation and configuration of circuits 34*a* and 34*b* are preferably substantially identical with that previously described with reference to activation circuit 34 and will not be described in greater detail hereinafter except to say that the respective outputs of inverters 42*a* and 42*b* are illustratively being shown as either without a buffer input resistance via path 100 or with such a buffer input resistance via path 102 for 42*a* and similarly via paths 104 and 106 for inverter 42*b*. thus, multiple functions can be controlled by the circuit illustrated in FIG. 2**, such as in a digital chronometer, by control of the appropriate conventional digital modules.

Figure 3:
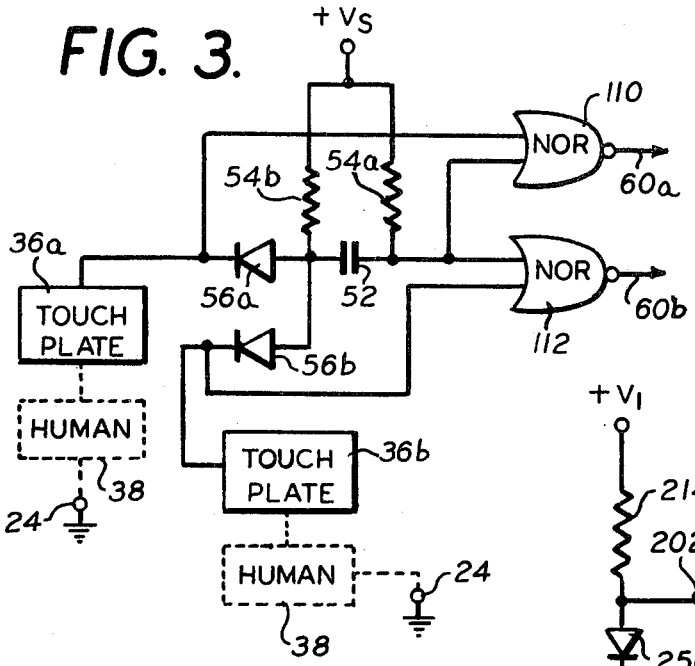
FIG. 3 is a schematic diagram, partially in block, of an alternative embodiment of the arrangement illustrated in FIG. 2.
Figure 4:
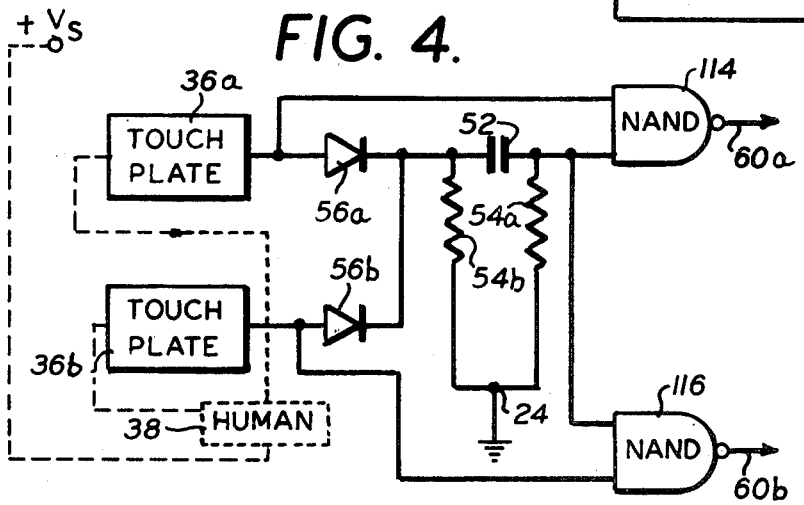
FIG. 4 is a schematic diagram, partially in block, of another alternative arrangement of the embodiment illustrated in FIG. 2.

Referring now to FIGS. 3 and 4, these circuits represent alternative embodiments of the multiple level shifter circuit illustrated in FIG. 2. In FIG. 3, the inverters **40*a*-42*a* are replaced by a conventional logic NOR gate 110 and inverters 40*b*-42*b* are replaced by another conventional logic NOR gate 112. Thus, the operation of FIG. 3 is similar to that described with reference to the electronic activation circuit 34 of FIG. 1 with conventional logic operation occurring for NOR gates 110 and 112, the output going low when the input goes high and, similarly, the output going high when the inputs go low. Similarly, FIG. 4 is identical to FIG. 3 with the exception that the NOR gates 110 and 112 are replaced by conventional logic NAND gates 114 and 116**, with the appropriate polarity changes, to accomplish the conventional logic functions of the NAND gates, the outputs going high when the inputs go low and visa versa, with the output of the circuit being low when both inputs are high.

Figure 6:
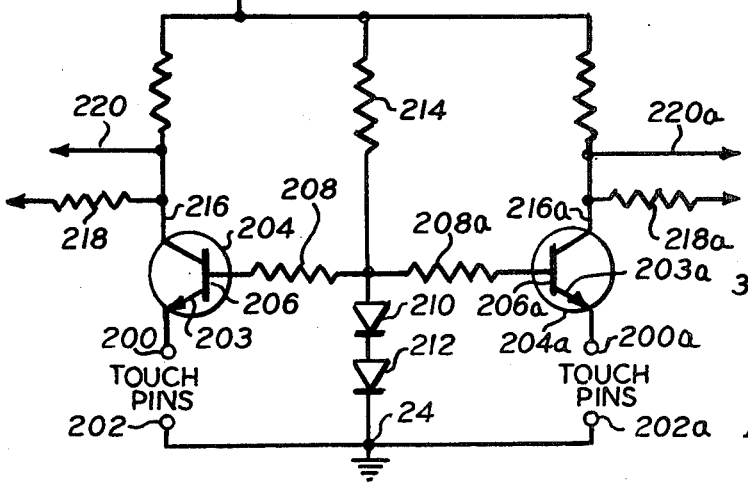
FIG. 6 is an alternative embodiment, similar to FIG. 5, for providing multiple function control.

Referring now to FIG. 6, an alternative embodiment of a touch sensitive electronic activation circuit, preferably for use in a digital timepiece having a chronometric display, is shown. As will be described in greater detail hereinafter, this touch sensitive circuit rather than being responsive to human touch, is responsive to the presence of a metallic low ohmic connection or touch for initiating the activation of the chronometric display. In place of the touch plate 36 of the embodiment of FIG. 1, a pair of spaced apart conductive touch pins 200 and 202 are preferably provided. FIG. 6 represents two identical circuits for enabling the provision of multiple function controls as with the circuits of FIGS. 2 through 4. Accordingly, one of the two identical circuits will be described with idential reference number identified by the letter *a* being used for identical functioning components in the other identical functioning circuit. Thus, the second circuit includes touch pins 200*a* and 202*a*. In the instance of a digital watch, as in the example of FIG. 1, touch pin 200 preferably is spaced from the metallic watch case 22 closely adjacent to touch pin 202 which is conductively connected to and protrudes from the watch case 22, with touch pin 202-202*a* being grounded at point 24 since the watch case 22 represents ground. If desired pin 202-202*a* may be omitted, with the required metallic connection then being provided between pin 200-200*a* and the case 22 itself. Touch pin 200 is connected to the emitter 203 of a transistor 204 which acts as a sensor for the circuit. Similarly, pin 200*a* is connected to the emitter 203*a* of transistor 204*a* which also functions as a sensor for the function control circuit. The base 206 of transistor 204 is preferably connected through a resistive impedance 208 to a pair of series connected diodes 210-212 which are, in turn, connected to ground 24 and, via another resistive impedance 214, to the voltage source $V_s$. Similarly, the base 206*a* of transistor 294*a* is connected through resistive impedance 208*a* to this common point to which diode 210-212 and resistive impedance 214 are connected. The collector 216 of transistor 204 provides the enabling signal output which, if a buffer resistance input for the enabling signal is required for the watch module, is provided through resistive impedance 218, or, if no buffer resistance input is required, as in the example shown in FIG. 1, is provided via path 220 to watch module 32. Similarly, the collector 216*a* output of transistor or sensor 204*a* is provided via impedance 218a or via path 220*a*.

As previously described with respect to the operation of the circuit of FIG. 6, preferably the circuit is designed so as to be insensitive to a moisture or water connection being present between touch pins 200-202 of 200*a*-202*a*, the circuit accordingly not producing the required enabling signal under such circumstances. In order to activate the circuit, preferably a metallic low ohmic connection, such as can be provided by a conventional metallic coin, must be made between the touch pins 200-202 or 200*a*-202*a* to complete the circuit from the emitter 203 or 203*a* to ground 24. The circuit is preferably arranged so that the sensor 204 or 204*a* will sense a conductive voltage less than the conductive or electrolysis voltage of water, such as less than 0.6 volts to ground. Any other conductive voltage higher than this which is provided to ground will not be recognized by the circuit; in other words, preferably the circuit will not provide the enabling signal. As will be described in greater detail hereinafter, above this conductive voltage of water, which in the example given, is above 0.6 volts, the circuit of FIG. 6 will comprise a high impedance circuit source so that little current will flow which will, thus, limit galvanic corrosion. Preferably, diode pair 210-212 provides a voltage to the base 206-206*a* of transistors 204 and 204*a* which results in a base-to-emitter 206-203, 206*a*-203*a* voltage for each of transistors 204 and 204*a* equivalent to the conductive threshold voltage for water of 0.6 volts. Thus, the open circuit voltage between the touch pins 200-202 or 200*a*-202*a* is preferably equivalent to this conductive threshold voltage of 0.6 volts so that normally no current flows between the touch pin 200 or 200*a* to the case represented by touch pin 202 or 202*a*. When a low ohmic metallic connection is provided between touch pins 200 and 202 or 200*a* and 202*a*, current flows through resistive impedances 214 and 208 for transistor 204 if the connection is between 200 and 202, or through resistive impedances 214 and 208*a* if the connection is between 200*a* and 202*a*, to turn on the appropriate sensor transistor 204 or 204*a* thereby dropping point 220 or 218 for transistor 204, or 220*a* or 218*a* for transistor 204*a*, to ground, which ground potential being low provides the enabling signal which, thus, activates the watch module 32 as in the embodiment of FIG. 1. As previously mentioned, buffer resistances 218 and 218*a* could be connected to watch module similar in operation to watch module 32 although requiring a buffer resistance at the input. When the low ohmic metallic connection is removed from the touch pins 200-202 or 200*a*-202*a* and no current then flows between the touch pins 200-202 or 200*a*-202*a*. Thus, points 220-218 or 220*a*-218*a* again go high terminating the provision of the enabling signal and, thus, terminating the chronometric display. It should be noted, that in each of the embodiments shown in FIGS. 1 through 7, the chronometric display is preferably only provided when the enabling signal is provided, the cessation of the provision of the enabling signal terminating the provision of the chronometric display. In the arrangement of FIG. 6, typically, by way of example, diodes 210 and 212 provide a voltage of 1.2 volts to the base of transistors 204 and 204*a* to provide the 0.6 volt base-to-emitter voltage, transistors 204 and 204*a* preferrably being, by way of example, Motorola 2N930A or 2N5089 transistors.

Figure 5:
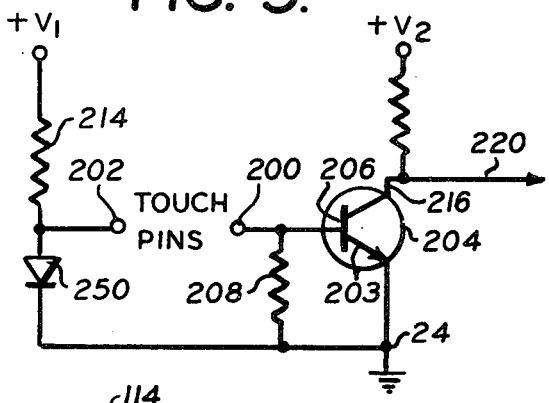
FIG. 5 is a schematic diagram of an alternative arrangement for an improved digital timepiece chronometric display activation network.

Referring now to FIG. 5, a circuit for providing one enabling signal, which represents half of the circuit in FIG. 6, is shown with the same reference numerals being utilized as in FIG. 6 for identical components. Preferably, the arrangement illustrated in FIG. 5 utilizes a super beta of bipolar transistor for transistor 204 and, with the parameters described above, preferably provides a 0.3 voltage drop across the pins 200-202 to prevent the enabling signal from being provided in response to the presence of water between the touch pins 200-202. In order to accomplish this, the valves of $V_2$ and $V_1$, such as typically $V_2$ being +3 volts and $V_1$ being +1.5 volts in the arrangement shown in FIG. 5, are selected so as to provide 0.3 volts between pins 200 and 202, and with diode 250 preferably being a silicon diode as are diodes 210 and 212 and transistor 204, preferably being germanium and having a beta 1000. In the arrangement shown in FIG. 5, the collector 216 output of transistor 204 is provided to path 220, assuming that the watch module 32, as with respect to the description of the circuit in FIGS. 1 and 6, operates in response to a low enabling signal so that when the collector 216 goes low or to ground, the output on 220 provides the enabling signal, thus activating the watch module 32 as in the arrangement of FIG. 6.

Figure 7:
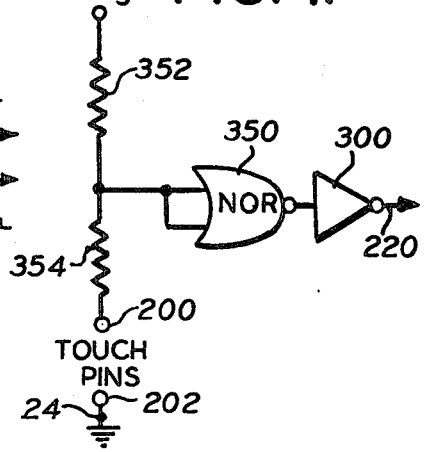
FIG. 7 is an alternative embodiment of the arrrangement shown in FIG. 5.

Referring now to FIG. 7, an alternative embodiment of the circuit of FIG. 5 is shown wherein the transistor 204 is replaced by inverter 300 and a conventional logic NOR gate 350 whose input is a resistive divider comprising resistive impedances 352 and 354 which, when water is present, does not drop below the switching point for NOR gate 350; however, when a low ohmic metallic connection is provided between pins 200 and 202, the resistive divider provides an input to NOR gate 350 which is below the switching point so that NOR gate 350 then provides a high output to inverter 300 whose output is in turn low which is the enabling signal which activates the watch module 32 to turn on the chronometric display.

It is to be understood that the above described embodiments of the invention are merely illustrative of the principles thereof and that numerous modifications and embodiments of the invention may be derived within the spirit and scope thereof, such as by providing a capacitive sensor touch plate network in place of the touch plate resistive voltage divider arrangement a typical capacitive sensor would not necessarily have the touch plate exposed but this plate could be covered by the plastic bezel or crystal of the watch or otherwise imbedded into the watch case. A typical capacitive sensor would use a capacitive or resistor-capacitor bridge network which would feed a level detector and the level detector would feed into line 48 of FIG. 1.

What is claimed is:

1. In a digital timepiece having a chronometric display means, a digital timing means operatively connected to said display means for providing chronometric timing signals thereto, and a power source means operatively connected to said timing means and display means for enabling the operation thereof, said digital timing means including first condition responsive means having an initial condition and an enable condition, said first condition responsive means being responsive to an enabling signal for changing from said initial condition to said enable condition for activating said chronometric display means only in said first condition responsive means enable condition to provide a chronometric display from said timing signal; the improvement comprising electronic means responsive to human touch for providing said enabling signal to said first condition responsive means, said electronic means comprising a resistive sensitive voltage divider switch means, said voltage divider means comprising conductive touchable means capable of providing a resistive impedance path to ground in response to human touch thereof, second condition responsive means having an initial condition and an enable condition, said voltage divider means providing an input signal to said second condition responsive means to control the condition thereof, said second condition responsive means condition being dependent on said input signal provided thereto, said touchable means being connectable between said power source and ground, said human touch of said touchable means rendering said touchable means conductive to ground to provide said resistive impedance path to change said second condition responsive means input signal from a first signal to a second signal, said second condition responsive means being responsive to said second signal for changing said second condition responsive means from said initial condition to said enable condition in response to said touchable means being rendered conductive to ground by said touch, said first condition responsive means condition being dependent on an input signal provided thereto and being in said enable condition only in response to receipt of said enabling signal as said input signal thereto, said first condition responsive means input being operatively connected to said second condition responsive means output for receiving said enabling signal therefrom, and delay means operatively connected between said second condition responsive means output and said first condition responsive means input, said delay means being responsive to the provision of said resistive impedance path for maintaining said first condition responsive means input signal as said enabling signal for a predetermined delay interval while said touchable means is still providing said resistive impedance path, said delay means thereafter changing said first condition responsive means input signal from said enabling signal to a different input signal while said enabling signal is still being provided from said second condition responsive means output, said first condition responsive means reverting to said initial condition from said enable condition in response to said different input signal, whereby said chronometric display is terminated after said predetermined delay interval during a continuous provision of said enabling signal for an interval in excess of said predetermined delay interval.

2. A digital timepiece in accordance with claim 1 wherein said delay means comprises means for substantially instantaneously changing said first condition responsive means from said enable condition back to said initial condition after said human touch is removed from said touchable means, said touch removal rendering said touchable means non-conductive to ground, whereby said chronometric display is terminated.

3. A digital timepiece in accordance with claim 1 wherein said delay means comprises a resistive-capacitive means having an associated RC time constant, said time constant providing said predetermined delay interval.

4. A digital timepiece in accordance with claim 1 wherein said voltage divider means comprises means for substantially instantaneously changing said second condition responsive means from said enable condition back to said initial condition after said human touch is removed from said touchable means, said touch removal rendering said touchable means nonconductive to ground, whereby said chronometric display is terminated.

5. A digital timepiece in accordance with claim 1 wherein said electronic means further comprises voltage divider means connected between said power source and said second condition responsive means, said voltage divider means comprising said touchable means and a first impedance connected in series therewith across said power source, said touchable means having a second associated impedance when non-conductive to ground and a different third associated impedance when rendered conductive to ground, said second associated impedance being greater than said first impedance, said second condition responsive means being charged from said initial condition to said enable condition in response to said touchable means associated impedance being at least as relatively low with respect to said first impedance as said third associated impedance.

6. A digital timepiece in accordance with claim 1 wherein said chronometric display comprises at least an alphanumeric display.

7. A digital timepiece in accordance with claim 1 wherein said chronometric display comprises at least a numeric display.

8. A digital timepiece in accordance with claim 1 wherein said chronometric display means comprises light emitting means for providing said chronometric display in response to said enabling signal.

9. A digital timepiece in accordance with claim 2 wherein said delay means comprises a resistive-capacitive means having an associated RC charge time constant, said time constant providing said predetermined delay interval, and diode means connected in parallel with said resistive means for providing a short-circuit discharge path when said second condition responsive means is in said enable condition and said touchable means is subsequently rendered non-conductive to ground by subsequent removal of said touch.

10. A digital timepiece in accordance with claim 3 wherein said second condition responsive means comprises inverter means, said delay means being connected between said inverter means output and said first condition responsive means input to provide said input signal thereto; said enabling signal being the output signal from said inverter means, said capactive means charging from an initial value for said input signal toward a predetermined value for said input signal upon said touchable means initially being rendered conductive to ground, said first condition responsive means being in said initial condition in response to said initial value input signal, said first condition responsive means changing from said initial condition to said enable condition when said charging commences.

11. A digital timepiece in accordance with claim 10 wherein while said touchable means is still conductive to ground, said first condition responsive means returns to said initial condition in response to said input signal thereto exceeding said predetermined value, said predetermined value being the half charged value of said capacitive means, said capacitive means charging in response to said RC time constant.

12. In a digital timepiece having a chronometric display means, a digital timing means operatively connected to said display means for providing chronometric timing signals thereto, a power source means operatively connected to said timing means and display means for enabling the operation thereof, said digital timing means including first condition responsive means responsive to an enabling signal for activating said chronometric display means to provide a chronometric display from said timing signals in response to said enabling signal; the improvement comprising controlled sensitivity electronic means solely responsive to conductive touch which provides a conductive voltage of less than the voltage at which water is substantially conductive for providing said enabling signal to said first condition responsive means, second condition responsive means having an initial condition and enable condition, said controlled sensitivity electronic conductive touch responsive means comprising at least a pair of spaced apart conductive touchable means connected between said power source and said second condition responsive means, said spaced apart conductive touchable means pair being selectively conductively bridgeable by a first conductive means having an associated conductive impedance less than the conductive impedance associated with said conductive water, and sensor means solely responsive to a first conductively bridgeable touch between said first pair of spaced apart conductive touchable means by said first conductive means, said first conductively bridgeable touch by said first conductive means providing said conductive voltage to said sensor means of less than the voltage at which water is substantially conductive, said second condition responsive means input being connected to said sensor means output and being responsive thereto, said sensor means providing a first control input signal to said second condition responsive means only in response to the sensing of said first conductively bridgeable touch of said spaced apart conductive touchable means pair by said first conductive means, said second condition responsive means changing from said initial condition to said enable condition only in response to said first control input signal, said enabling signal being provided only in said enable condition, whereby the provision of said chornometric display is insensitive to the conductively bridgeable touch of conductive contaminants between said spaced apart conductive touchable means pair which provides a conductive voltage equal to or greater than the voltage at which water is substantially conductive.

13. A digital timepience in accordance with claim 12 wherein said electronic means further comprises means for biasing said sensing means with a voltage at least equivalent to the voltage at which water is substantially conductive when said spaced apart conductive touchable means pair is not conductively bridgeably touched with said first conductively bridgeable touch.

14. A digital timepiece in accordance with claim 4 wherein said chronometric display comprises at least an alphanumeric display.

15. A digital timepiece in accordance with claim 4 wherein said chronometric display comprises at least a numeric display.

16. A digital timepiece in accordance with claim 4 wherein said chronometric display means comprises light emitting means for providing said chronometric display in response to said enabling signal.

17. A digital timepiece in accordance with claim 13 wherein said electronic means with said biased sensing means comprises a high impedance circuit source for limiting current flow therethrough when said spaced apart conductive touchable means pair is not conductively bridgeably touched with said first conductively bridgeable touch for limiting galvanic corrosion.

* * * * *